United States Patent [19]

Pollack

[11] Patent Number: 4,666,339

[45] Date of Patent: May 19, 1987

[54] ARTICULATED TOWER MOORING SYSTEM

[75] Inventor: Jack Pollack, Reseda, Calif.

[73] Assignee: Amtel, Inc., Providence, R.I.

[21] Appl. No.: 617,954

[22] Filed: Jun. 7, 1984

Related U.S. Application Data

[63] Continuation-in-part of Ser. No. 137,840, Apr. 7, 1980, abandoned.

[51] Int. Cl.[4] ..... E02D 21/00

[52] U.S. Cl. ..... 405/202; 405/224

[58] Field of Search ..... 405/202, 224, 195, 211; 114/230

[56] References Cited

U.S. PATENT DOCUMENTS

| | | | |
|---|---|---|---|
| 2,986,888 | 6/1961 | Borrmann et al. | 405/224 |
| 4,100,752 | 7/1978 | Tucker | 405/202 X |
| 4,109,479 | 8/1978 | Godeau et al. | 405/202 X |
| 4,152,088 | 5/1979 | Vilain | 405/202 X |
| 4,155,673 | 5/1979 | Yashima | 405/224 |

*Primary Examiner*—David H. Corbin

*Attorney, Agent, or Firm*—Freilich, Hornbaker, Rosen & Fernandez

[57] ABSTRACT

An offshore mooring system is provided which is especially useful for mooring ships in moderately shallow seas such as on the order of 300 feet. The system is of the type which includes a tower having a lower end pivotally mounted to the sea floor and an upper end lying above the sea surface and connected through a hawser to a ship. A group of long chains have lower ends anchored at locations spaced about the tower, and upper ends connected to an upper portion of the tower. The chains extend in loose catenary curves, with most of the chain lengths lying on the sea floor in the vertical tower condition, to permit the tower to tilt in any direction by at least 20° from an initial vertical orientation before one of the chains is pulled taut.

3 Claims, 2 Drawing Figures

ARTICULATED TOWER MOORING SYSTEM

This application is a continuation-in-part of U.S. application Ser. No. 137,840, filed Apr. 7, 1980, now abandoned.

BACKGROUND OF THE INVENTION

Articulated tower systems have emerged as one of the most reliable low maintenance tanker mooring systems for use in remote hostile environments. One advantage of this type of system over those which utilize a freely floating buoy held by caternary chains, is the fact that fluid-carrying conduits can be placed to extend through the rigid tower to protect them, where this is desired. Another advantage is that the tower can extend high above the water to provide an attachment point for a hawser connected to a ship, without destabilizing the system. In a typical articulated loading tower system, the rigid tower has a buoyancy compartment near the water surface, and a ballast chamber near the bottom of the tower to offset much of the buoyancy. When a moored tanker pulls the top of the tower to one side, tilting of the tower causes the buoyancy compartment to move in an arc about the pivot joint. The horizontal component of this movement times the vertically acting buoyant force results in a righting movement that tends to restore the tower to its vertical position. However, as the water depth becomes shallower, a given angle of tower tilt results in an ever decreasing moment arm which proportionately decreases the restoration force. This can be compensated for by utilizing a larger buoyancy compartment, but this results in a large and costly system.

At moderate to shallow depths, prior art articulated tower mooring systems not only have the disadvantages of requiring larger buoyancy and ballast chambers, and larger bases and pivot couplings, but also result in increased effective pivoting stiffness of the system and a consequent reduction in the tower natural period of oscillation. That is, for the ship mooring force to produce as small an angle of tower tilt as in deeper water, a stiffer tower results that tends to oscillate with a shorter oscillation period. The pivoting stiffness of the system results in more frequent breakage of hawsers connecting the tower to a ship, inasmuch as the tower applies large forces when a ship drifts slightly, rather than applying small forces over a long distance of ship drifting. The higher natural frequency of the tower is disadvantageous, because it is closer to typical wave frequencies, which tends to amplify the dynamic wave induced motion of the tower and cause large relative motions between the tower and a large relatively stable tanker. These large relative motions between tower and tanker are difficult to accommodate with conventional mooring methods. A mooring system of the articulated loading tower type, which avoided the great stiffness and large oscillation amplitude of prior art systems in water of moderately shallow depth, such as on the order of 300 feet, would be of great value.

SUMMARY OF THE INVENTION

In accordance with one embodiment of the present invention, an offshore mooring system of the articulated tower type is provided, which is of relatively low pivoting stiffness and relatively high natural period of oscillation in moderately shallow sea depths. The system includes a tower having a lower end pivotally connected to the sea floor and an upper end portion lying at a height at least near the sea surface, and a group of chain devices having upper ends coupled to the upper portion of the tower and lower ends anchored to the sea floor at locations spaced about the tower. The chain devices extend in moderately loose curves when the tower is vertical, with most of the chain length then lying on the sea floor, so that tilting of the tower to one side causes a chain on the other side to be pulled off the sea floor and thereby raised, and a chain on the same side as tower tilting to be further lowered onto the sea floor. The raising of a chain off the sea floor on one side and lowering of a chain on the other side onto the sea floor results in the chains applying forces that tend to restore the tower towards a vertical orientation, but with very low tower stiffness and therefore with a long natural frequency of oscillation.

The novel features of the invention are set forth with particularity in the appended claims. The invention will be best understood from the following description when read in conjunction with the accompanying drawings.

DESCRIPTION OF THE PREFERRED EMBODIMENT

Figure 2:
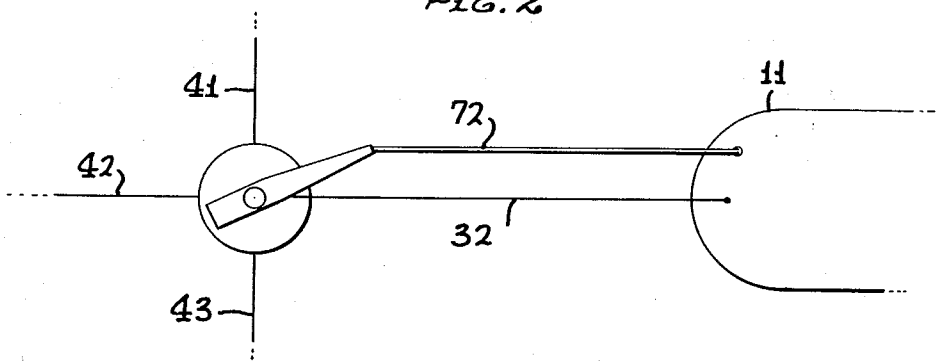
FIG. 2 is a partial plan view of the system of FIG. 1.

The figures illustrate an offshore mooring system 10 which can be utilized to moor a tanker 11 or other vessel while a fluid is transferred between an underwater pipeline 12 and the tanker. The system includes a tower 14 which comprises a generally vertical, tall but thin structure, having a lower end 16 near the sea floor F and an upper end 18 lying at least near the sea surface S and preferably considerably above it. The lower end 16 of the tower is pivotally connected to the sea floor through a tilt joint 20 that permits the tower to tilt about two horizontal axes 22, 24 on a base 26 that is mounted on the sea floor. The upper end 18 of the tower carries a rotating boom 28 which has a hawser-connecting eyelet 30 that holds one end of a hawser 32 which extends to the vessel 11.

The mooring arm 28 is mounted to rotate without limit about a vertical axis 34 on the upper end 18 of the tower, to permit the arm to accommodate drifting of the vessel 11 about the tower under the influence of current, winds, and waves. When the vessel drifts due to changes in the steady environmental drift forces, the tower tilts as to the position 14A, to permit such drifting. It is important that the tower be biased towards a largely vertical orientation, so that it tends to return to its initial orientation at 14, and to pull the vessel back to its initial location at 11. Part of the restoring force arises from the buoyancy of the tower 14 which may include a small buoyancy chambers 37 near its upper end, while additional restoring force is provided, in accordance with the present invention, by the addition of a group 36 of moderately loose chain devices or chains 41–44, as will be described below.

Part of the force tending to restore the tilted tower to its vertical position, arises from the buoyancy of the tower. The tower 14 can, for example, be constructed of a hollow metal tube which has positive buoyancy when submerged as shown at 14 in FIG. 1. When the tower tilts to the position 14A, a component of the buoyant forces tends to return the tower to its initial vertical orientation. It is normally desirable to design the system so that the maximum angle of tilting E of the buoy from its initial vertical position, is normally under about 20°, with extreme deflection under worse storm conditions being no more that about 30°. Tilting by more than about 30° would lower the top of the tower and the hawser, excessively.

If the tower without chains 41–43, were utilized in a sea location of considerable depth which is over 600 feet (and the tower were correspondingly taller) then by the time that the tower were tilted 20°, the top of the tower would have moved sidewardly by a considerable distance which was over 200 feet and its average height would be lowered considerably. As a result, such a tall tower would apply a mooring load to the ship in a gradual manner, over a drifting distance of over 200 feet, and a large amount of potential energy would be stored during such drifting which would be utilized to return the ship and tower to their initial position. Furthermore, such a tall tower would have a long natural oscillation period considerably longer than the waves. Thus, such a tall tower could function acceptably. If the sea depth were very shallow such as much less than 300 feet (and the tower were correspondingly shorter), then the tower would be tilted at 30° after the ship drifted by less than 150 feet, and the average additional submersion of the tower would be relatively small, so that not much potential would be stored for use in returning the ship to its initial position. The amount of stored potential energy can be increased in such a tower by utilizing a large buoyancy chamber along the tower, so that even moderate tower tilting results in considerable energy being stored. However, this large potential energy is still stored over a relatively small distance of ship drifting, so that large loads are applied through the hawser to the ship. In addition, such a short tower would have a short natural period of oscillation close to that of the waves, and therefore would be subjected to considerable dynamic loading. Such loadings can result in frequent breaking of the hawser unless special measures are taken to prevent this.

In moderately shallow depths, such as 200 to 400 feet, large buoyancy chambers can be utilized with some effectiveness on tilting tower mooring systems, although such chambers result in several disadvantages. An important disadvantage is that a large buoyancy chamber lying near the sea surface tends to be moved by waves because of its large cross sectional area and volume. In addition, a pivoting tower of small to medium length with a large buoyancy chamber near the top, has a relatively stiff pivoting characteristic, or in other words tends to oscillate at a relatively low period. The average period of waves encountered in seas is about 12 seconds. A pivoting tower acts like an upside-down pendulum, and has a period dependent upon its length and the distribution of its buoyancy. A tower of about 300 feet length which carries most of its buoyancy near its upper.end at the sea surface, can have a natural period of about 20 to 30 seconds (obviously, the exact period depends upon the particular length and buoyancy distribution). As the natural period of the tower approaches the period of the waves, the tower motion will be considerable as the tower oscillation will be dynamically amplified due to the matching of the tower and wave periods. Since the length of each wave is about 600 feet, and tankers are typically much longer than a half wave length, tankers typically are not moved back and forth much by waves. It is desirable to construct the pivoting tower with a natural oscillation period much greater than twice the expected wave period to avoid excessive dynamic amplifications of its motion, and therefore it is desirable to avoid the use of large buoyancy chambers at the top of pivoting towers of moderately short length.

In accordance with the present invention, the group of moderately loose catenary chains 41–44 are utilized in conjunction with the pivoting tower 14, to supply a restoring force that tends to restore the tower to its initial vertical position after it has been deflected to one side. Each of the chains such as 42 has an upper end **42*u* coupled to an upper end portion of the tower, and a lower end 42W anchored to the sea floor F at a location spaced a distance G far from the bottom of the tower. Each chain is long enough so that it extends in a moderately loose curve between its upper end 42*u* and a location such as 52 on the sea floor where the chain first reaches the sea floor. The upper portion 42*u* of each moderately loosely curved chain extends at a moderate angle A from the horizontal which is between +40° and 70°. The angle A of the upper chain end is preferably between 50° and 60°. The chain extends in a catenary curve to the sea floor, where the angle B of the chain from the horizontal has deoreased to less than 10°. As a result, the chain accommodates considerable tilting of the tower, of over 20°, as to the 30° tilt position 14A** without the chain becoming taut.

When the tower tilts as to the position 14A, potential energy is stored primarily by the lifting of a long length of the chain 42 off the sea floor to position 42A. In the tower position 14, only the chain portion inward of point 52 was held above the sea floor. However, in the extreme tilt position E of 30°, the long length of chain 52 between points 54 and 56 is lifted off the sea floor. The chain is of considerable weight, so that such lifting of the chain portion 52 to an average height 58 stores considerable potential energy. The use of a long chain 42 which has most of its length resting on the sea floor in the vertical tower position, is provided so that even in the extreme tilted tower position at 14A, the tower is not stiff. That is, the restoring force does not increase greatly with a small additional angle of tilt. This is especially so, because there is a lapse of time between the application or removal of tilting force to the tower and corresponding lifting or lowering of the chain. As a result, the tower has a long period of oscillation comparable to that of a long tanker, and the hawser 32 will not break in moderate waves.

In addition to a length 52 of one chain 42 being lifted off the sea floor, a portion, 60 of the opposite chain 44 is laid onto the sea floor. The buoyancy chamber 37 is relatively small, since its purpose is to urge the tower up rather than to store energy when it is lowered slightly during printing, and therefore the chamber is not pushed hard by waves.

Figure 1:
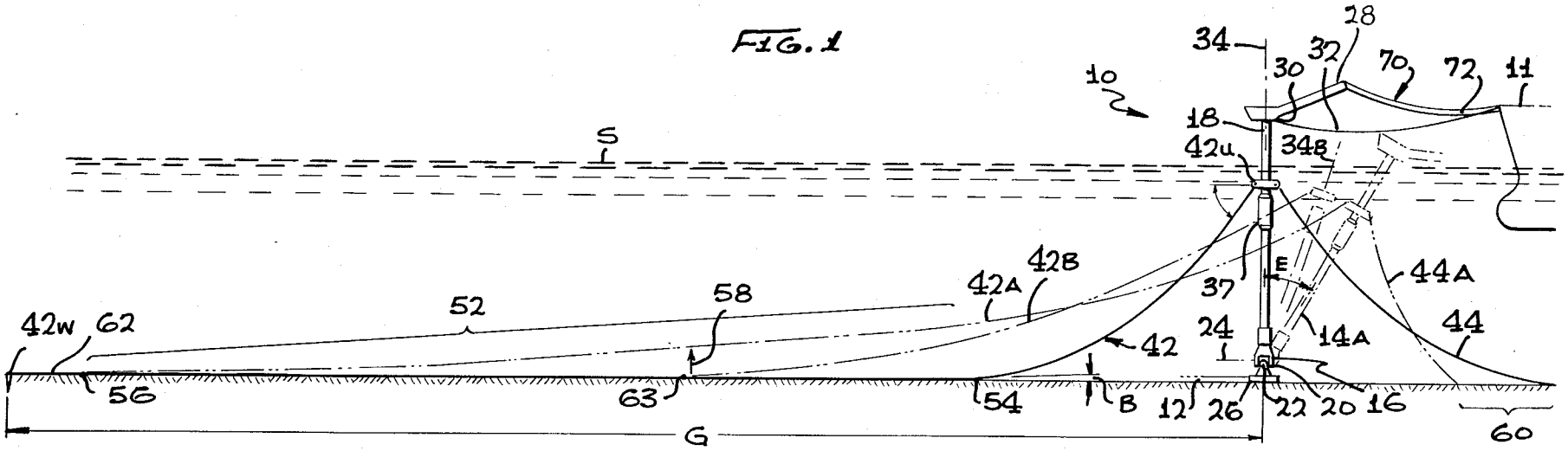
FIG. 1 is a side elevation view of an offshore mooring system constructed in accordance with one embodiment of the present invention.

FIG. 1 is drawn to the scale of a mooring system that has been designed for a sea of depth D of 275 feet. Each chain such as 42 has a length of 1700 feet. When the tower is vertical, the chain extends at an initial angle A of 60° and a 475 feet length of chain extends from **42*u* and reaches the sea floor at a point 54 spaced 360 feet from the tower. When the tower tilts, by 30° from the vertical, an additional chain length 52 of about 1125 feet is raised off the sea floor. A lowermost, or outermost chain portion 62** of about 100 feet always rests on the sea floor to assure that the tower will never be stiffly held. Chains are commercially sold in multiples of 90 feet length, and sufficient chain is specified so that at least one 90 foot length always remains on the sea floor. It also can be seen that the angle of the chain from the horizontal varies from a large angle A between 40° and 70° at the top to a small angle B of much less than half as much (i.e. less than 20°) at the bottom, with the angle B actually approaching 0°.

Mooring systems of this type permit tower tilt of at least 20°. At a 20° tilt indicated at 34B, the chain at 42B will be lifted up to a point 63 off the sea floor. The distance between points 63 and 54 is greater than the depth of the sea.

The mooring system is generally used to transfer hydrocarbons between the vessel and the undersea pipeline. A conduit 70, which includes a hose 72 extending between the loading arm and vessel, carries fluid along the height of the tower between the undersea line 12 and the vessel.

Thus, the invention provides a pivoting tower mooring system for moderately shallow depths such as about 200 feet to 400 feet, which provides considerable restoring force to moor a ship, without utilizing a large buoyancy chamber near the upper end of the tower, and while assuring that the tower is never stiffly held. This is accomplished by the use of a group of at least three chains extending in moderately loose curves from an upper portion of the tower to the sea floor, with at least half of the length of each chain lying on the sea floor when the tower is in its vertical quiescent position. The long length of chain which rests on the sea floor in the quiescent tower position, and which is lifted as the tower tilts, avoids stiffness in tower tilt and therefore provides a long resonant tower frequency which resists reaction to waves.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An offshore mooring system for mooring a ship in a sea comprising:

a tower having a lower end lying nearer the sea floor than the sea surface, said lower end pivotally connected to the sea floor to permit the tower to tilt away from a vertical orientation, said tower having an upper end portion lying at a height at least near the sea surface and having means for tying to a ship; and a plurality of chain devices having upper ends coupled to the upper end portion of the tower and lower ends anchored to the sea floor at locations spaced about the lower end of the tower, said chain devices each having a length more than twice the height of the sea and extending in moderately loose curves when the tower extends in a substantially vertical orientation, a majority of the length of each chain device resting on the sea floor when the tower is vertical, said curves being of a looseness wherein the tower picks up a length of chain off the sea floor as it tilts, whereby to avoid pivotal stiffness in the tower.

2. The system described in claim 1 wherein:

when said tower is vertical the upper end of said chain device extends at an angle of between 40° and 70° from the horizontal, and the lower ends of said chain devices extend at an angle of less than 10° from the horizontal, whereby the chain devices extend in loose curves to avoid stiffness.

3. The system described in claim 1 wherein:

said tower can pivot at least 20° in any compass direction away from the vertical, and said tower lifts a long length of chain off the sea floor when it tilts by 20° from the vertical, said long length of chain lifted off the sea floor being longer than the height of the sea.

* * * * *